US005862722A

United States Patent [19]

Cislo

[11] Patent Number: 5,862,722

[45] Date of Patent: Jan. 26, 1999

[54] ADJUSTABLE WRENCH

[76] Inventor: Casimer J. Cislo, 3732 Erie Dr., Orchard Lake, Mich. 48324

[21] Appl. No.: 717,068

[22] Filed: Sep. 20, 1996

[51] Int. Cl.[6] ..... B25B 13/16

[52] U.S. Cl. ..... 81/164; 81/175; 81/DIG. 5

[58] Field of Search ..... 81/155, 164, 175, 81/DIG. 5, 165–168

[56] References Cited

U.S. PATENT DOCUMENTS

| | | | |
|---|---|---|---|
| 258,673 | 5/1882 | Preston . | |
| 580,685 | 4/1897 | Hall | 81/164 |
| 957,214 | 5/1910 | Johnson | 81/175 |
| 1,284,731 | 1/1918 | Lynds . | |
| 1,349,564 | 8/1920 | Evits et al. | 81/164 |
| 1,361,050 | 12/1920 | Hahn . | |
| 1,608,432 | 11/1926 | Ryan | 81/164 |
| 1,697,764 | 1/1929 | Heinz . | |
| 1,932,113 | 10/1933 | Long | 81/DIG. 5 |
| 1,955,351 | 4/1934 | Tennant | 81/164 |
| 2,506,373 | 5/1950 | McClain | 81/164 |
| 2,722,150 | 11/1955 | Green | 81/DIG. 5 |
| 2,912,891 | 11/1959 | Neff . | |
| 3,046,821 | 7/1962 | Legris | 81/164 |
| 3,173,317 | 3/1965 | Neff . | |
| 4,325,275 | 4/1982 | Colvin | 81/128 |
| 4,967,613 | 11/1990 | Cone . | |

FOREIGN PATENT DOCUMENTS

| | | | |
|---|---|---|---|
| 25333 | 1/1923 | France | 81/175 |
| 1180 | 3/1877 | United Kingdom | 81/164 |
| 7317 | 5/1889 | United Kingdom | 81/175 |

*Primary Examiner*—David A. Scherbel
*Assistant Examiner*—Joni B. Danganan
*Attorney, Agent, or Firm*—John R. Benefiel

[57] ABSTRACT

An adjustable wrench has a slotted body member and a handle threaded into a bore in a body member stem and protruding into one end of the slot. A movable jaw piece is rotatably mounted to the protruding handle end and slidable in the slot. A pair of angled fixed jaw faces is formed at the far end of the slot, while corresponding jaw faces are formed on the movable jaw piece. Relative rotation of the handle and body member causes relative advance or retraction of the movable jaw piece in the slot to adjust the spacing between the sets of jaw faces to fit the wrench to bolt heads or nuts of various sizes. The structural support afforded by the handle-movable jaw piece connection enables low cost construction and compact structure allowing greater accessibility to recessed bolt heads and nuts. A locking rod extends within the handle in some embodiments, with a locking knob at the remote handle able to be tightened to hold an adjusted position. Unlike other wrenches, the extended handle provides for more precise remote jaw adjustment and allows for simultaneous jaw adjustment of the handle and locking knob by a one-hand overlapping hand grip. The jaw faces are inclined from being perpendicular to the longitudinal axis of the handle to angle the handle slightly and provide more hand clearance.

19 Claims, 4 Drawing Sheets

ADJUSTABLE WRENCH

BACKGROUND OF THE INVENTION

This invention concerns adjustable wrenches and more particularly adjustable wrenches of the type having a fixed jaw and an aligned movable jaw with a corresponding V-shaped jaw face able to engage hex threaded fasteners over a range of sizes.

Adjustable wrenches having opposing flat faces such as the so-called "crescent" wrench can only engage a pair of opposite sides of a hex bolt head or nut so as to be of limited use by mechanics, as attempts to exert a substantial torque may round off the corners of the flats. This type of wrench is also bulky, limiting access to a nut or bolt head in tight quarters.

It has long been proposed to provide an adjustable wrench having opposing jaws each of which are formed with angled faces so that together both jaws engage four of the hex sides. This engagement greatly improves the ability to exert a torque on the bolt head or nut.

The necessity of maintaining alignment of the jaws with each other to properly engage the hex sides requires a more complex wrench configuration and imposes other requirements such that previously devised wrenches of this type have not been completely successful.

Typical is the wrench shown in U.S. Pat. No. 1,361,050 issued on Dec. 7, 1920 for a "Wrench." This design features a fixed vee-shaped jaw at one end of a slot and a movable vee-shaped jaw adjustably movable towards and away from the fixed jaw. The movable jaw is supported by machined gibs on the sides of the slot.

The machined gibs required by the construction of the wrench described in that patent involves costly manufacturing steps and may not perform satisfactorily in use due to weakness in the connections provided between some of the major components.

See also U.S. Pat. Nos. 1,697,764; 2,912,891; 1,284,731; and 258,673 for further examples of such adjustable wrenches.

The need for rugged precision support of the movable jaw has necessitated the use of jaw gibs and other costly measures.

A more recent version of this general approach is shown in U.S. Pat. No. 4,967,613 issued on Nov. 6, 1990 for a "Reversible Adjustable Wrench." That patent uses a captured thumbwheel as an adjustment nut engaged with a small diameter threaded shaft fixed to the movable jaw piece for carrying out the adjustment movement of the movable jaw.

This wrench has achieved some commercial success, but also has certain drawbacks. The movable jaw is primarily supported by the slot sides, necessitating relatively thick sidewalls on which side extension portions of the movable jaw ride to resist the large forces tending to tip the movable jaw piece when the handle exerts torque on the hex head fastener.

The wider side extension portions create an obstruction which requires greater clearance space around the nut or bolt head.

The thumbwheel and the thick slot sides together contribute to an overall bulkiness of the wrench.

All of the above wrenches are not particularly convenient to use for various reasons.

For example, the projecting jaw lips are typically sized at their outer end to fit the largest hex head for which the wrench is designed. Thus, the jaw often cannot fit into recessed openings for smaller nut sizes.

Often, the jaws incorporate side flanks which do not engage the hex shape and hence while adding bulk, do not contribute to the ability to exert torque on the fastener.

The object of the present invention is to provide an adjustable wrench which incorporates V-shaped jaws and body which is more compact, able to be used effectively in confined spaces, and enables precision guidance of the movable jaw, and is more conveniently adjustable in use, yet is simple, rugged, and capable of sustaining considerable torque without requiring costly manufacturing steps and special assembly tools in being constructed.

SUMMARY OF THE INVENTION

This object and others, which will become apparent upon a reading of the following specification and claims, are achieved by an adjustable wrench comprised of an elongate body member formed at one end with a lengthwise extending wide slot opening.

An integral tubular stem at one end of the body member has a bore opening into one end of the slot, which bore is formed with an internal thread engaging an external thread formed at one end of an elongate handle received into the tubular stem bore.

The one end of the handle is mounted to the movable jaw piece so as to allow rotation while providing a sturdy support of the movable jaw piece on the handle end.

A V-shaped fixed jaw face is formed at one end of the slot, and the movable jaw piece has a corresponding V-shaped jaw face on one end opposing and aligned with the fixed jaw face.

The movable jaw piece may be moved along the slot by the interaction of the handle and body member threads upon rotation either of the handle or the tubular stem of the body member while the other is held, to adjust the jaw face spacings to fit the wrench to hex heads of a range of sizes. This can be done with either hand gripping the handle and the thumb rotating the tubular portion.

In one embodiment, the movable jaw piece is held by a locking rod threaded into the shank and extending within a lengthwise bore in the handle, with a locking knob threaded onto a protruding end of the rod. Turning the knob to be tightened against an end face of the handle firmly and more precisely maintains the adjusted position of the movable jaw piece and eliminating any looseness in the parts.

In other embodiments, the jaw shank is axially retained in a blind bore by a locking snap ring or a barbed washer, which allows rotation of the shank in the bore.

In another arrangement, rather than forming the movable jaw piece with a shank, the stub diameter of the handle end is received in a socket bore in the movable jaw piece and held there with the locking rod threaded firmly into a threaded hole at the socket bottom.

Each of the movable and fixed jaws have partially rounded convergent projecting portions to enable gripping of recessed hex shapes. Each side of the V-shaped surface of the fixed jaw is extended over the width of the adjacent side wall on either side of the slot in order to widen the engagement area with the hex sides. This enhances the leverage able to be exerted by the jaws on the hex head, and increases the range of hex sizes able to be accommodated by the wrench.

Size markings are applied across the width of the top surface of each of the slot sidewalls or on the handle adjacent the end of the tubular stem of the body member.

The movable and fixed jaws are preferably inclined at a slight angle to the handle axis to create hand clearance at the other end of the handle.

DETAILED DESCRIPTION

Figure 1:
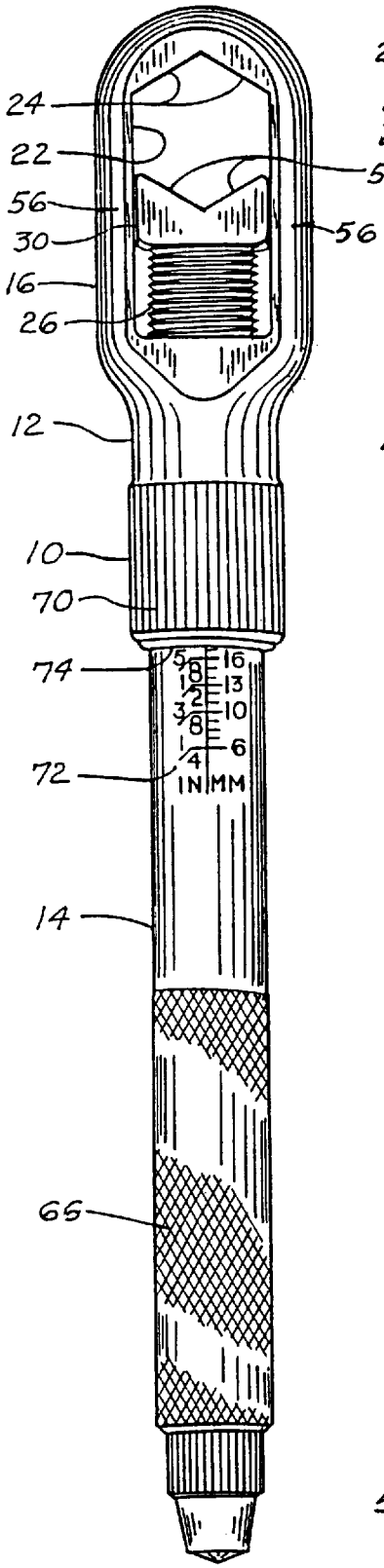
FIG. 1 is a top plan view of an adjustable wrench according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 1–4, the adjustable wrench 10 according to a first embodiment consists of an elongated body member 12 mounted to one end of an elongated handle 14. The body member 12 includes a slotted portion 16 remote from a narrower stem portion 18 having an internal bore 20 receiving one end of the handle 14. The handle 14 could be constructed from commercially available tubing formed with an appropriate inside diameter. The slotted portion 16 is formed with an elongated opening comprising a wide slot 22 defined by a pair of sidewalls 56 terminating with an end portion having a fixed jaw face 24 consisting of a flat V-shaped surface, each side extending at an angle matched to that of hexagonal bolt or nut sides, i.e., 120° with respect to each other.

One end of the handle 14 has an externally threaded section 26 which engages an internally threaded section 28 of the inside diameter of the bore 20. The remaining extended portion of the bore 20 is slidably fit to pilot on the outside diameter of the externally threaded section 26. The internally threaded bore section 28 opens into the space defined by the slot 22, allowing the handle threaded section 26 to be disposed therein with one end protruding into the slot 22 of the body member 12.

A movable jaw piece 30 is rotatably mounted to the threaded end of the handle 14 by means of a tapered shank 32 integral with the jaw piece 30, shank 32 fit within a correspondingly tapered section 34 of an internal bore 36 formed through the length of the handle 14. The shoulder 33 of jaw piece 30 contacting the end of the handle 14 prevents the tapered surfaces from moving into locking engagement so that rotation of the shank 32 in the tapered bore section 34 is allowed. The tapered configuration of the shank 32 is preferred over a straight sided configuration since this shape maximizes the diameter of the shank 32 adjacent the movable jaw piece 30 without involving a step down in the diameter to that of the clearance bore 36, provided for a locking rod 38, described below.

The movable jaw piece 30 is retained within the tapered bore section 34 in the end of the handle 14 by means of a locking rod 38 extending completely through the entire length of the bore 36 within the handle 14 and having one end 40 threaded into a threaded bore 42 within the shank 32.

The threaded connection of the rod one end in bore 42 is secured against loosening during normal use of the wrench 10 as by applying a LOCTITE™ compound at the same time. Friction jamming of the thread or a tapered thread may also be done, or by any other means for preventing rotation during use but allowing disassembly. This fixes the thread during normal use, but allows disassembly for servicing of the wrench 10.

Figure 11:
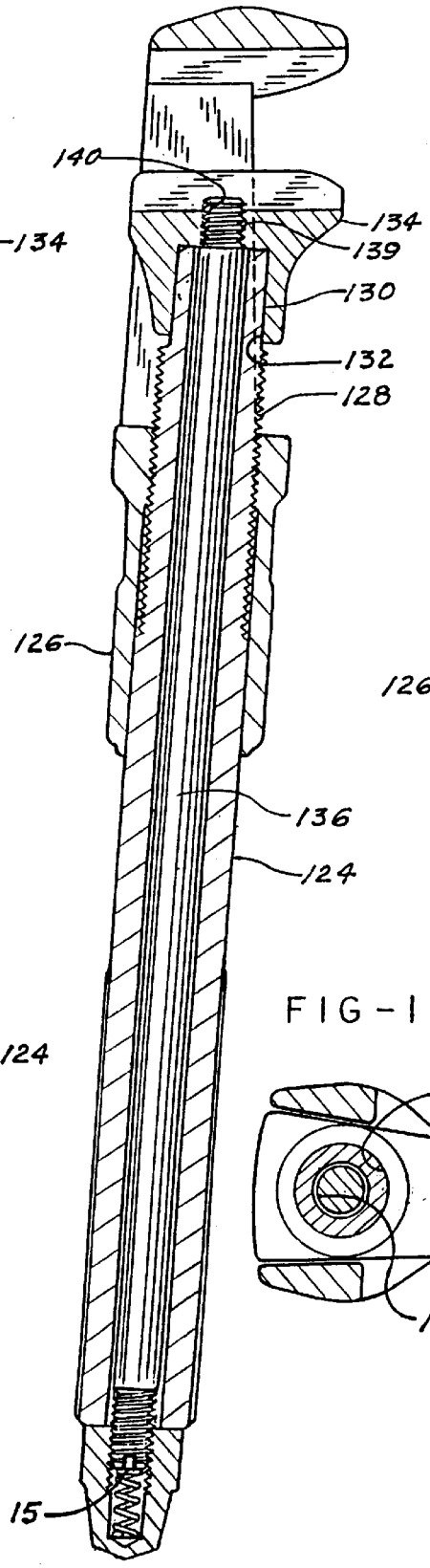
FIG. 11 is a partially sectional view of the embodiment of the adjustable wrench shown in FIG. 10.
Figure 12:
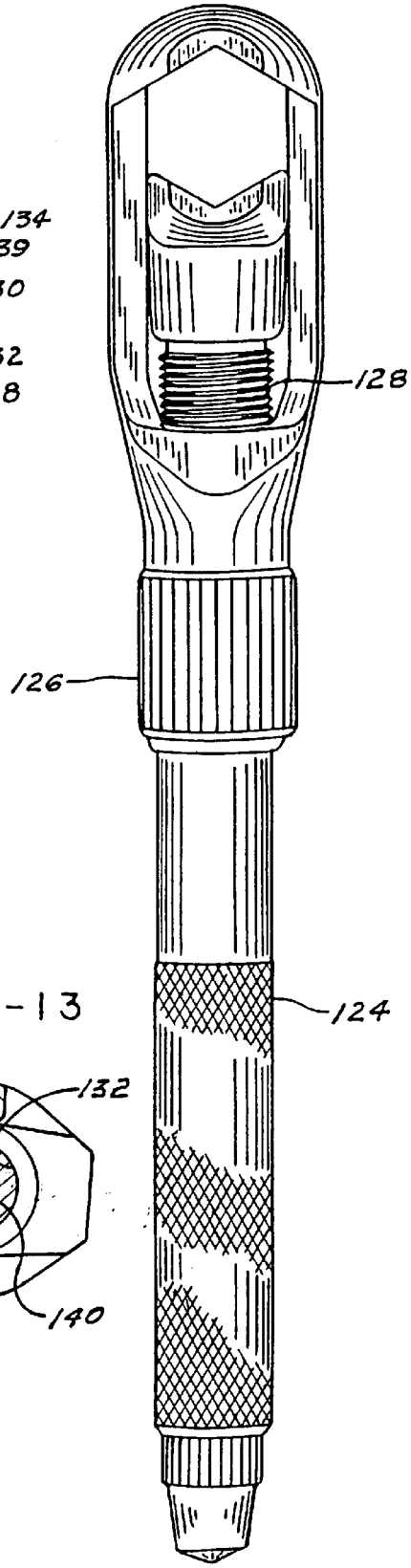
FIG. 12 is a reverse view of the embodiment of the adjustable wrench shown in FIG. 10.
Figure 13:
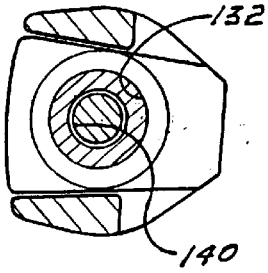
FIG. 13 is a transverse sectional view taken through the embodiment of the adjustable wrench shown in FIG. 10.

The opposite end of the locking rod 38 protrudes out of the other end of the handle 14 so as to enable a tool to be used to overcome the resistance of the secured threaded connection. A screw driver slot 15 (FIG. 11) can be machined into the protruding end of the locking end 38 for this purpose.

The opposite end of the locking rod 38 is a threaded portion 44 which is threaded into an internally threaded bore 46 machined into a locking knob 48. An anti-rotation spring 50 bears against the end of the threaded section 44 received into the threaded bore 46 of the locking knob 48. The spring 50 provides additional friction and prevents the threaded section 44 from unintended tightening upon rotation of the handle 14 when a size adjustment is being made.

The friction force created by the spring 50 is overcome when tightening the locking knob 48 to bear against the end face of the handle 14 to hold it in an adjusted position. More secure tightening and locking of the handle can be obtained by concurrently grasping the handle and locking knob with the same hand and rotating clockwise, and conversely loosening by rotating counterclockwise.

The movable jaw piece 30 also has V-shaped jaw face 52 formed therein aligning with and opposing the fixed jaw face 24 within the body member 12 at the opposite end of the slot 22 from where the threaded end 26 of the handle 14 enters.

The fixed jaw face 24 has portions which project outwardly away from the surface of the sidewalls 56 defining the slot 22.

Figure 3:
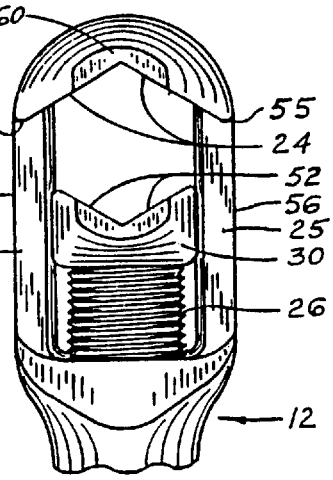
FIG. 3 is a fragmentary reverse plan view of the jaw and body member of the adjustable wrench according to the invention shown in FIG. 1.
Figure 14:
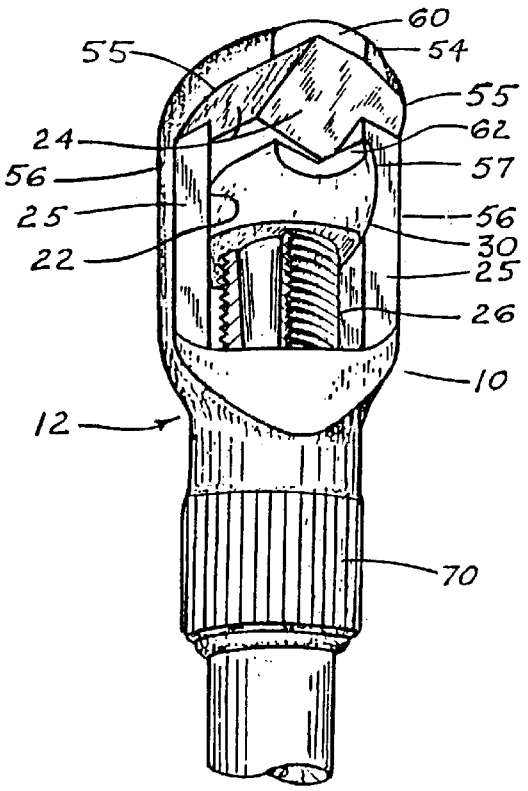
FIG. 14 is a perspective reverse view of the body and configured jaw and lip end components partially broken away of the adjustable wrench shown in FIG. 1.

The fixed jaw face 24 also extends laterally out over the surface 25 of the sidewalls 56 (as seen in FIGS. 3 and 14) to be of greater width than the slot 22 and the movable jaw face 52. This creates a wider engagement jaw surface, which by its geometry improves the gripping ability of the wrench considerably on the largest hex size fasteners that the wrench 10 can accommodate.

The outer edges 55 of the fixed jaw 54 are configured to converge towards each other, from a maximum spacing at surfaces 25 to a narrower lip 57 at the outer tip, where a flat 60 is formed. The edges 55 are partially curved in the configuration shown in FIG. 3A. The edges 55 can have a radiused corner as shown in FIG. 3, or a sharp corner as shown in FIG. 14.

Thus, the largest nut or bolt head A (shown in phantom outline) is engaged by the jaw surface 24 at a maximum spacing, while the smaller heads B, C are engaged further in by the narrower lips.

This convergency creates a narrower width of the fixed jaw lip 24 at its outer tip.

Similarly, the movable jaw piece 30 (FIGS. 1 and 2) projects outwardly in the same direction towards the lower side of the wrench 10, extending the jaw face 52 to be of the same depth as fixed jaw face 24.

Figure 2:
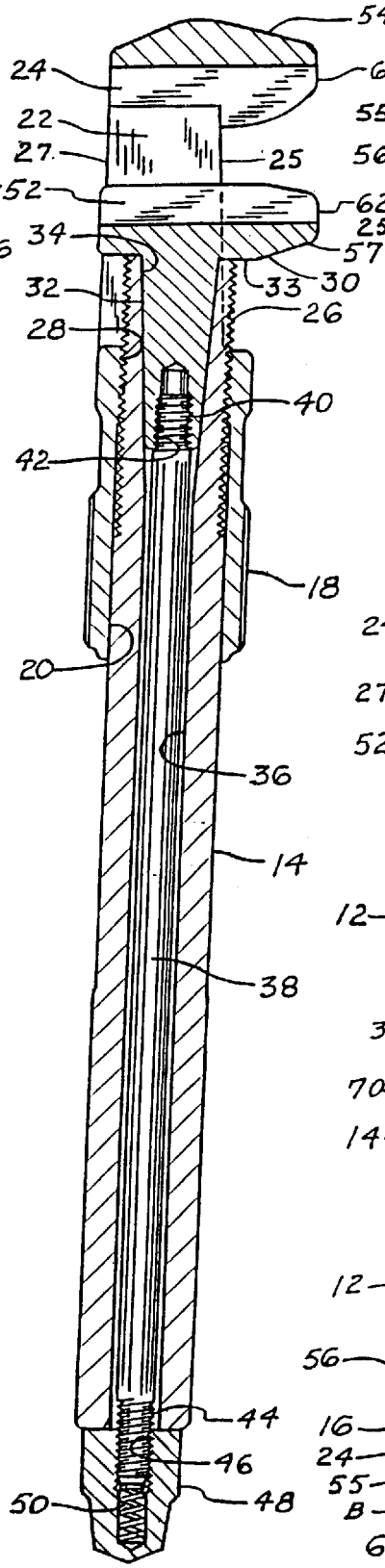
FIG. 2 is a partially sectional side view of an adjustable wrench according to the invention shown in FIG. 1.
Figure 15:
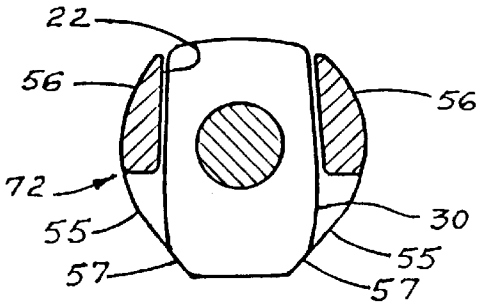
FIGS. 15, 16, 17, 18, 19, 20, and 21 are transverse sectional view of alternate configurations of the body side rails, jaws, and end lips of the adjustable wrench according to the present invention.

The movable jaw 30 having jaw face 52 as shown in FIGS. 1 and 2 is also convergently contoured in the region 57 which overlaps with the fixed jaw face 24, as seen in FIG. 15, terminating in a flat 62 of the same width as flat 60 in the lip 54. Thus, the combined width of the jaws 54, 30 (FIG. 2) is reduced at the tips forming narrower lips thereof to enable access in tight quarters without reducing the size of the hex heads engageable by the wrench 10 or gripping effectiveness of the wrench.

Figure 3A:
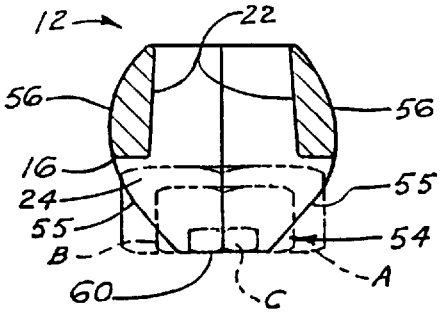
FIG. 3A is a transverse sectional view taken across the body member of the adjustable wrench shown in FIG. 1, showing the projecting fixed jaw lip in relation to various hex fastener sizes shown in phantom.
Figure 5:
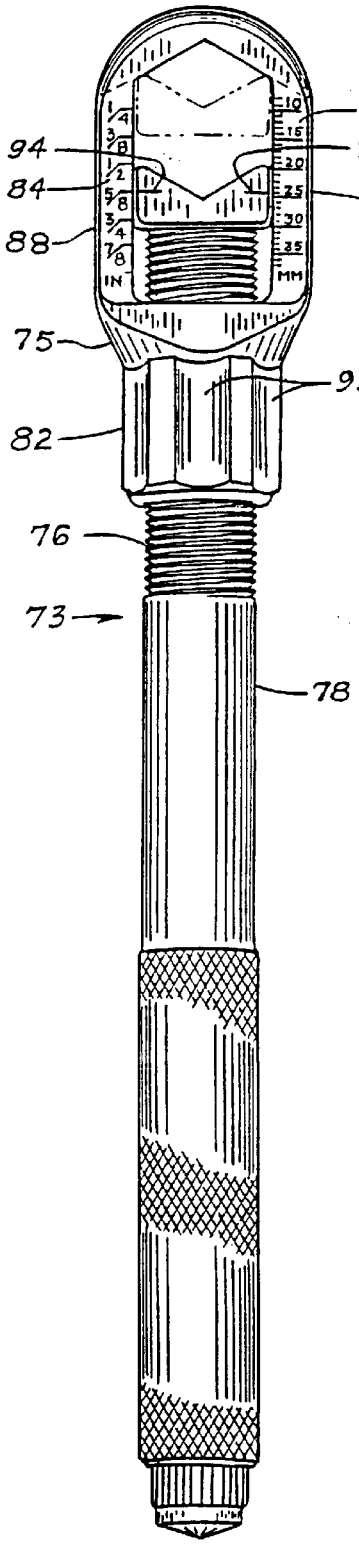
FIG. 5 is a plan view of a compact version of the adjustable wrench according to the invention.
Figure 6:
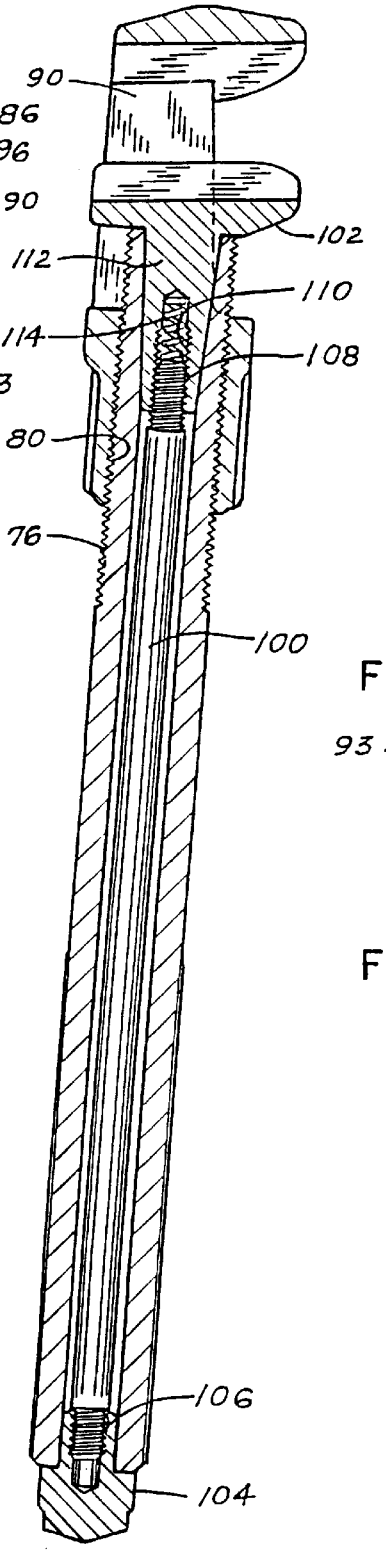
FIG. 6 is a partially sectional view of the adjustable wrench shown in FIG. 5.

The flanks of the sidewalls 56 may also be rounded to provide a trim appearance and minimize the bulk of the wrench (FIG. 3A).

The end of the body member 12 may also be rounded as seen in FIGS. 1 and 3.

The inside faces of the sidewalls 56 defining the slot 22 are flat and uninterrupted with gibs or other mating contours for the sides of the jaw piece 30 which also are flat and uninterrupted. A slight draft angle may exist for manufacturing purposes, which angle is matched by the sides of the movable jaw piece 30, which provides some precision guidance of the movable jaw piece 30 as well as to prevent rotation thereof when adjustments are made.

The outside diameter of the threaded section 26 of the one end of the handle 14 provides a structurally rigid support for the movable element jaw member 30 such as to obviate the necessity for machined ways or gibs formed between the movable jaw element and the slot sides 22, allowing for a more compact structure of the body member 12.

Figure 4:
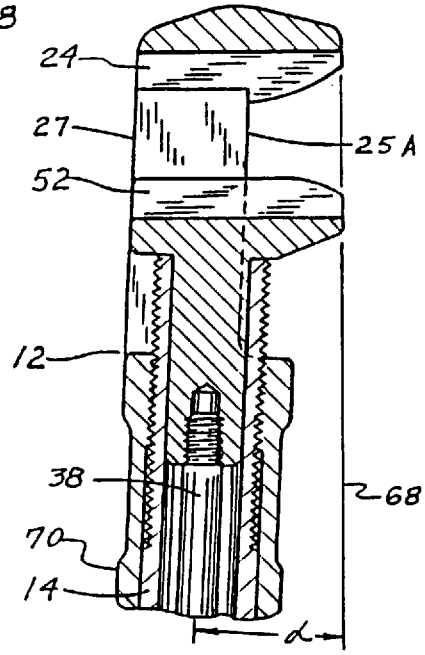
FIG. 4 is a partially sectional fragmentary view of an alternate embodiment of the adjustable wrench according to the invention.

The fixed jaw faces 24 and movable jaw faces 52 are preferably formed to lie at a slight angle $\alpha$ to the axis of the handle and the body member 12 as indicated in FIG. 4 showing the angle $\alpha$ which may range from 0° to 50°, to locate the knurled section 66 of the handle 14 away from the plane of the surface of the bolt head, providing increased hand clearance with a surface represented by the line 68 in FIG. 4.

The lip ends of the jaws 54 and 30 will have slightly changing angular relationships as the handle 14 is threaded in and out of the body member 12 and the jaw faces 24 and 52 move towards and away from each other, it is contemplated that the relationship of the surfaces 24 and 52 is set relative to the axis of the corresponding handle 14 and body member 12 so as to come into alignment in the plane of the surface 68 at approximately 40% of the full opening travel of the movable jaw 52 in the position shown in FIG. 4. This minimizes any misalignments at the extreme adjusted positions of the fixed and movable jaw members, although such misalignment is slight and negligible. The larger misalignment resulting from this relationship is better tolerated at the full opening adjusted position since the larger nut and bolt head sizes have more generous chamfers to accommodate such slight misalignments.

The body member 12 may also be provided with various serrated surfaces 70 shown in FIG. 1 at its inner tubular end to allow manipulation and adjustment of the wrench size with one hand by grasping the handle knurled portion 66 and rotating the section 12 by thumb engagement with the serrated barrel 70.

It is noted that a tightly adjusted condition of the jaw faces 24, 52 can be maintained with one hand exerting a turning force on the handle 14 with the jaw faces 24, 52 engaging a hex fastener. This arrangement also allows a tighter grip on damaged hex shapes to ease removal of deformed fasteners, and also frees the hand for extraneous use.

Alternatively, the serrated surface 70 can be grasped and the handle section 66 rotated.

Inch-metric size scale markings 72 can be provided on the outside diameter of the handle 14 immediately adjacent the lower end surface 74 of the body member 12.

The locking knob 48 can be selectively tightened in any adjusted position so as to maintain an adjusted position during use of the wrench. The handle can be quickly, easily, and more firmly locked or unlocked by grasping the handle and locking knob simultaneously with one hand and providing a slight hand rotation.

The depth of the sides 56 is chosen to be relatively deep to provide sufficient strength and precision movable jaw alignment with the fixed jaw, while maintaining a trim profile of the wrench, as noted above.

Figure 19:
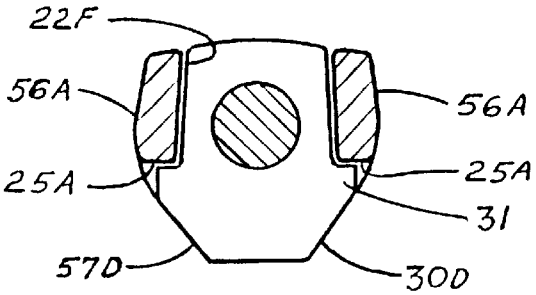

The underside 25 of the side walls 56 are preferably angled relative to the top side as shown in FIG. 2 for increased strength. However, sides 25A must be parallel to the upper surface 27 shown in FIG. 4 where sliding engagement of the movable jaw is contemplated as shown in FIG. 19, described hereinafter. A sturdy support of the movable jaw piece 30 is provided by the relatively large diameter thread section 26, and by the extended length of the bore 20 piloting the threaded section 26 within the member 12 and acting as the primary source of structural rigidity of the movable jaw 30 in resisting forces imposed during wrenching of a nut or bolt.

FIGS. 5–8 show a more compact and lighter duty version of the wrench according to the present invention. This more compact wrench 73 features a shorter length body member 75 which has a threaded bore 80 receiving the threads 76 on one end of the handle 78. The body member 75 does not have an unthreaded bore section, so that the threads 76 are exposed beyond the section 80 of the body member 75 provided with a threaded bore 80.

In this embodiment, the inch and metric scales are provided on a respective surface 84 and 86 of the side rails 88 and 90 of the body member 75. The movable jaw piece 102 has suitable marks 94 and 96 aligning with the scale markings for the inch and metric scales to conveniently allow presetting adjustment of the wrench.

The shorter length stem 82 is shown with traction lobes 93 for carrying out such adjustments.

In this embodiment, the locking rod 100 is engaged with the movable locking jaw 102 and the locking knob 104 in a reverse manner from that shown in the above-described embodiment. That is, a threaded section 106 at the lower end of the locking rod 100 is threaded into and firmly secured to the lock knob 104 as by using Loctite™, thread jamming, or other means prior to installation into the handle 78.

The opposite threaded end 108 is threaded into a bore 110 in the shank 112 of the movable locking jaw 102 with a friction spring 114 provided to create friction resisting unthreading of the locking rod 100 during normal rotation of the handle to carry out adjustments.

Figure 7:
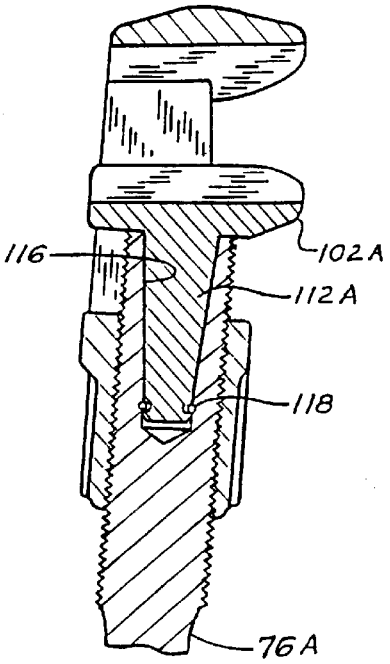
FIG. 7 is a fragmentary partially sectional view of an alternate form of the adjustable wrench shown in FIG. 5.
Figure 8:
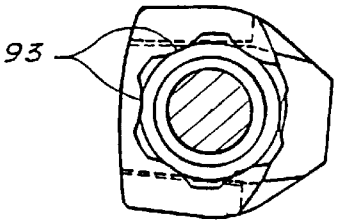
FIG. 8 is an end view of the adjustable wrench shown in FIG. 7.

FIG. 7 shows a further modification in which a movable jaw member 102A is provided with a shank 112A which is received in a blind tapered bore 116, with a retaining ring 118 allowing relative rotation between the solid shank handle 76A while being axially retained in the bore 116. The retaining ring 118 is seated in an aligned slot in the outside diameter of the shank 112A and the inside diameter of the tapered bore 116. In this embodiment, the locking rod 100 is eliminated.

Figure 9:
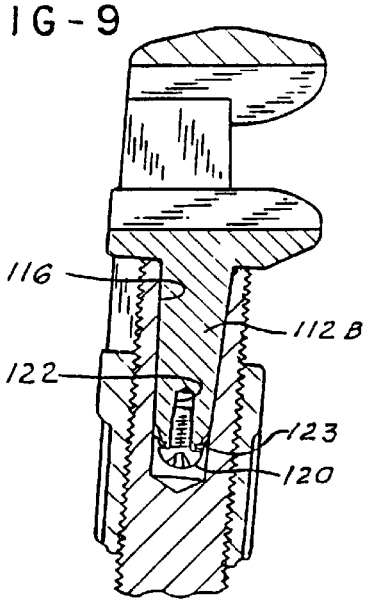
FIG. 9 is a fragmentary sectional view of another alternate version of the adjustable wrench shown in FIG. 5.
Figure 10:
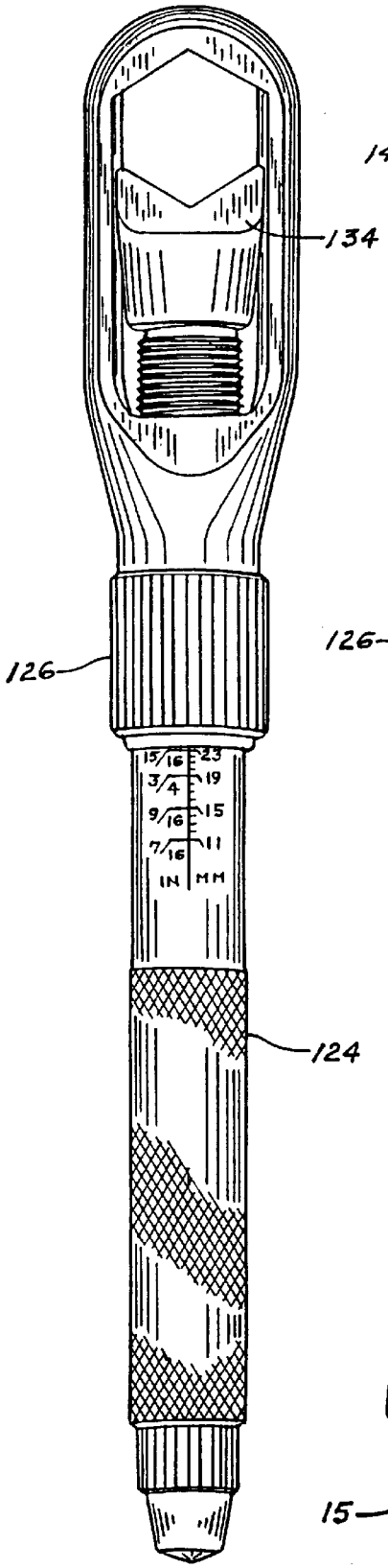
FIG. 10 is a top plan view of another embodiment of the adjustable wrench according to the present invention.

FIG. 9 illustrates a variation of the arrangement shown in FIG. 7 in which a self-threading screw 120 is received into an axial bore 122 in the end of the shank 112B. A barb washer 123 is first assembled against the head of the self-threading screw 120, which washer prevents withdrawal of the shank 112B while allowing rotation in the bore 116.

FIGS. 10–13 show another alternative embodiment in which the handle 124 engaged in body 126 is formed with an externally threaded end section 128 adjacent a reduced diameter endmost portion 130 which is slidably received in a bore 132 of the movable jaw member 134.

A locking rod 136 has a threaded end 139 which is firmly threaded into a threaded bore 140 located at the bottom of the bore 132.

FIG. 15–21 show examples of the many possible shapes of the movable and fixed jaws.

FIG. 15 illustrates the relationship between the movable jaw member 30 in the slot 22 with a slight draft angle provided in the embodiment of FIG. 1.

Figure 16:
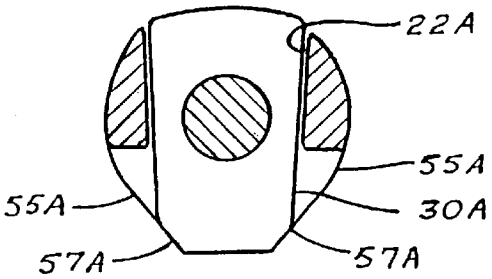

FIG. 16 illustrates a variation in which the slot 22A has a reverse draft angle.

Figure 17:
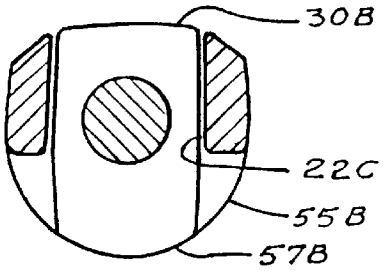

The wrench of FIG. 17 has a slot 22C with no draft angle. The edges 55B, 57B are rounded eliminating the end flats 60, 62.

Figure 18:
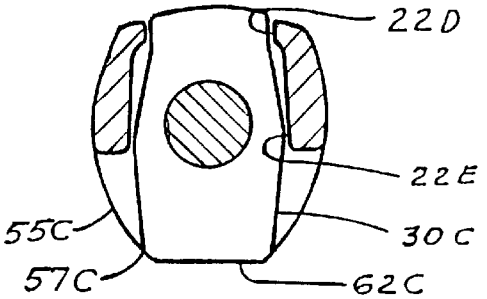

In FIG. 18, a narrowed section 22D and a widened section 22E provides spaced line contacts with the sides of the movable jaw 30C. The flat 62C is wider, so that only the edges 55C are convergent.

FIG. 19 shows wing extensions 31 on the movable jaw 30D beneath the surfaces 25A of the side rails 56A forming the slot 22F to aid positioning of the movable jaw 30D during assembly. The movable jaw piece 30D is widened to extend over the sides 25A. The wing extension would have a radius edge or matching angle of fixed jaw face 24, shown in FIG. 3A.

Figure 20:
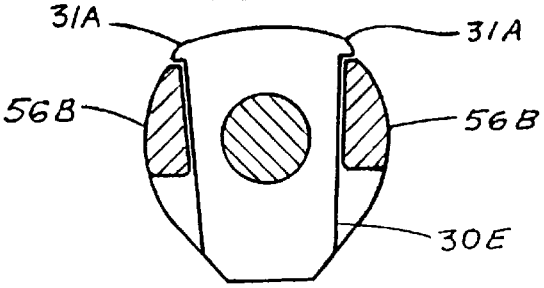

In FIG. 20, top extensions 31A are provided on the movable jaw 30E riding on the opposite surfaces of the sides 56B to make it easier to position the movable jaw piece 30E and the body member 12 shown in FIG. 1 during assembly.

Figure 21:
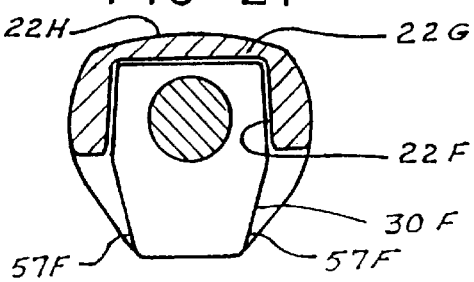

In FIG. 21, the slot 22G is configured with a bridging web 22H such that the movable jaw piece 30F is slidable therein. The movable jaw edges 57F are convergent over their entire length.

Accordingly, it can be appreciated that a more compact but rugged V-shaped adjustable jaw wrench has been provided as a result of a mounting of a more compact movable jaw piece 30 to one end of the handle 14 itself and, in the heavy duty versions, the extended piloting of the handle within the body member. A more convenient adjustment locking arrangement is provided which also functions to axially retain the movable jaw in the handle in the heavy duty version of the embodiment according to the present invention. A broader hex nut capacity range has been provided within the more compact body.

The wrench configurations described allow manufacture of the wrench at relatively low cost while insuring a structurally sound construction and more precise engagement of the parts, easily capable of withstanding the required loading and at the same time of relatively streamlined external configuration.

I claim:

1. An adjustable wrench for turning hexagonal threaded fasteners comprising:

an elongated handle having opposite ends;

an external thread formed on said handle adjacent one of said ends;

a body member having a portion formed with a lengthwise slot having parallel sides defined by a pair of spaced side rails, an end portion, and a barrel shaped stem, said end portion formed with a fixed V-shaped jaw face at one end of said slot;

said barrel shaped stem having a through bore opening into said slot at an opposite end from said jaw face, said threaded end of said handle interfit to said bore opening, said bore opening having a portion threadably receiving said threaded one end of said handle, relative rotation of said handle and said body member thereby causing axial adjusting movement therebetween;

a movable jaw piece sturdily supported on said threaded one end of said handle, providing a structurally rigid support of the movable jaw piece, said jaw piece being allowed to rotate relative said handle one end to remain rotationally stationary while said handle is rotated, said movable jaw piece having a corresponding V-shaped jaw face opposing and aligned with said fixed jaw face;

said sturdy mounting of said movable jaw piece to said handle one end and said interfitting of said handle one end to said bore opening acting as the primary source of structural rigidity of said movable jaw in resisting forces imposed during wrenching of a hexagonal fastener to obviate the need for gibs or machined walls on said slot side;

said movable jaw piece being movable within said slot, said jaw piece and said slot having flat sides which are not in structural engagement as said movable jaw piece is advanced or retracted in its position relative said fixed jaw faces by relative rotation of said handle and said body member causing axial advance or retraction of said movable jaw piece in said slot to adjust the spacing between said fixed and movable jaw faces.

2. The adjustable wrench according to claim 1 wherein said movable jaw piece is formed with a shank portion and said handle is formed with a bore in said one end having said external thread adjacent thereto, said movable jaw piece shank closely fit into said handle bore and being of a length substantially longer than said jaw piece along the direction of said handle one end bore, and means retaining said shank therein while allowing relative rotation between said handle and said movable jaw piece.

3. The adjustable wrench according to claim 2 wherein said shank is tapered, and a section of said bore receiving said shank is correspondingly tapered.

4. The adjustable wrench according to claim 2 wherein said means retaining said shank in said handle bore comprises a mechanical retainer mounted on an end of said shank and engaging a wall of said bore so as to allow rotation but restrain axial movement of said shank out of said bore.

5. The adjustable wrench according to claim 1 wherein said handle is formed with a through bore, and further including a locking rod disposed extending within said through bore and attached to said movable jaw, an end of said locking rod protruding out the other of said handle ends, and further including a locking knob attached to said protruding end, said locking knob advanceable upon rotation thereof by threaded connection means to be brought into tightened frictional engagement with an end face of said handle other end to hold said movable jaw piece in any adjusted position and to hold said law piece on said handle one end; and, spring means preloading said thread means to prevent unintended rotation of said locking knob on said threaded connection means.

6. The adjustable wrench according to claim 1 wherein said slot has flat uninterrupted sides and said movable law piece has flat uninterrupted sides.

7. The adjustable wrench according to claim 1 wherein said movable jaw piece has a bore formed therein receiving said one end of said handle, and means holding said handle one end therein while allowing rotation of said handle one end in said bore.

8. The adjustable wrench according to claim 1 wherein said side rails have flat surfaces on an upper side thereof, at least one of said flat surfaces inscribed with a size scale, said movable jaw piece having a corresponding reference fiducial inscribed thereon.

9. The adjustable wrench according to claim 1 wherein said fixed jaw has a lip which projects approximately perpendicularly away from bottom surfaces on said side rails, and extends laterally over said surfaces of said side rails to be wider than said slot.

10. The adjustable wrench according to claim 9 wherein both said fixed jaw face and said movable jaw face have side edges converging from a maximum spacing at said side rail bottom surfaces to a lip portion which is substantially narrower than said slot.

11. The adjustable wrench according to claim 10 wherein said movable jaw face has a lip which protects approximately perpendicularly away from said side rail bottom surfaces with said edges which converge in conformity with said convergence of said fixed jaw side edges.

12. The adjustable wrench according to claim 11 wherein said side edges of both said fixed and movable jaw are curved and terminate in a flat tip.

13. The adjustable wrench according to claim 1 wherein said body member stem has an extended smooth bore adjacent said internal thread, said externally threaded portion of said handle slidably fit in said extended smooth bore to strengthen and align the connection with said handle.

14. The adjustable wrench according to claim 1 wherein said body member barrel shaped stem is formed with serration surface features facilitating rotation thereof.

15. The adjustable wrench according to claim 1 wherein said movable jaw piece has a wing extension on each side extending over respective side rails.

16. The adjustable wrench according to claim 1 wherein said side rails are connected by a bridging portion defining one side of said slot, said movable jaw piece fit against an inner surface of said bridging portion.

17. The adjustable wrench according to claim 1 wherein said fixed jaw face and said movable jaw piece jaw face each project from said member and said handle respectively, approximately perpendicularly to a longitudinal axis of said handle but inclined slightly from true perpendicularity to incline said body member and said handle to be angled slightly away from a plane of a hex head fastener engaged by said jaw faces, and wherein said respective jaw faces moves into alignment with a common plane at an intermediate adjusted spacing of said jaw faces.

18. The adjustable wrench according to claim 1 wherein a series of size markings are on said handle along a section of said handle adjacent an end of said stem whereat said handle enters into said stem bore, said markings corresponding to English and metric units and grouped along each side of a longitudinal common line allowing selective review and adjustment of a particular size at a single glance when said handle is gripped by the hand and said stem is manipulated by the thumb without obstructing the visibility of said size markings.

19. An adjustable wrench comprising:

an elongate handle having opposite ends;

an external thread formed on said handle adjacent one of said ends;

a body member having a portion formed with a lengthwise slot defined by a pair of spaced side rails, an end portion, and a stem, said end portion formed with a fixed V-shaped jaw face at one end of said slot;

said stem having an internally threaded through bore opening into said slot at an opposite end from said jaw face, said bore threadably receiving said threaded end of said handle, relative rotation of said handle and said body member causing axial adjusting movement therebetween;

a movable jaw piece mounted to said threaded end of said handle and slidably fit in said slot, said movable jaw piece having corresponding V-shaped jaw face opposing and aligned with said fixed jaw face;

said movable jaw piece closely confined in said slot as said movable jaw piece is advanced or retracted in its position relative said fixed jaw faces by relative rotation of said handle and said body member causing axial advance or retraction of said movable jaw piece in said slot to adjust the spacing between said fixed and movable jaw faces;

said handle formed with a through bore;

a locking rod disposed extending within said through bore and attached to said movable jaw, an end of said locking rod protruding out the other of said handle ends; and, a locking knob attached to said protruding end, said locking knob advanceable upon rotation thereof by threaded connection means to be brought into tightened frictional engagement with an end face of said handle other end to hold said movable jaw piece on said handle one end and to secure said handle in any adjusted position in said threaded bore of said body member.

* * * * *